US008220884B2

(12) United States Patent
Berger

(10) Patent No.: US 8,220,884 B2
(45) Date of Patent: Jul. 17, 2012

(54) DEVICE FOR ADJUSTABLE MOUNTING OF THE RUNNER OF PULL-OUT GUIDES ON DRAWERS

(75) Inventor: Horst Berger, Bielefeld (DE)

(73) Assignee: Alfit AG, Gotzis (AT)

( * ) Notice: Subject to any disclaimer, the term of this patent is extended or adjusted under 35 U.S.C. 154(b) by 842 days.

(21) Appl. No.: 12/280,667

(22) PCT Filed: Feb. 22, 2007

(86) PCT No.: PCT/EP2007/001514

§ 371 (c)(1),
(2), (4) Date: Dec. 3, 2008

(87) PCT Pub. No.: WO2007/096156

PCT Pub. Date: Aug. 30, 2007

(65) Prior Publication Data

US 2009/0167128 A1 Jul. 2, 2009

(30) Foreign Application Priority Data

Feb. 25, 2006 (DE) ..... 20 2006 003 035 U

(51) Int. Cl.
*A47B 88/04* (2006.01)

(52) U.S. Cl. ..... 312/334.4

(58) Field of Classification Search ..... 312/330.1, 312/334.1, 334.4, 334.5, 333, 334.8, 334.27, 312/334.14

See application file for complete search history.

(56) References Cited

U.S. PATENT DOCUMENTS 2,928,696 A * 3/1960 Hiers ..... 384/19
4,842,422 A * 6/1989 Nelson ..... 384/19
5,056,879 A * 10/1991 Rock et al. ..... 312/334.27
5,375,922 A * 12/1994 Brustle et al. ..... 312/334.4
5,439,283 A * 8/1995 Schroder et al. ..... 312/334.4

(Continued)

FOREIGN PATENT DOCUMENTS

AT 409067 B 5/2002

(Continued)

OTHER PUBLICATIONS

English Language Abstract for AT 409067.

(Continued)

*Primary Examiner* — James O Hansen
(74) *Attorney, Agent, or Firm* — Norris, McLaughlin & Marcus, P.A.

(57) ABSTRACT

Device for adjustable mounting of the rear end of runners (18) of pull-out guides on the inner end region, facing away from the front panel, of drawers (10) or other furniture components withdrawably mounted in the carcass of a piece of furniture, with a mounting element (22) which is disposed so as to be adjustable in height on the rear end of the runner (18) and which can be brought into sliding engagement with a receiving arrangement provided on the rear of the drawer (18) by relative displacement of the drawer on the runner in the longitudinal direction of the runner.

The mounting element (22) is disposed on a lever arm which is mounted on the runner so as to be pivotable in a vertical plane about an axis (A) extending horizontally at right angles to the longitudinal direction of the runner (18), and a height adjusting mechanism is provided which acts on the one hand on the lever arm and on the other hand on the runner.

6 Claims, 7 Drawing Sheets

U.S. PATENT DOCUMENTS

| | | | | |
|---|---|---|---|---|
| 5,664,855 | A * | 9/1997 | Lautenschlager et al. | 312/334.4 |
| 2001/0019235 | A1* | 9/2001 | Hammerle | 312/334.4 |
| 2002/0158557 | A1* | 10/2002 | Weichelt | 312/334.4 |
| 2003/0234603 | A1* | 12/2003 | Salice | 312/334.5 |

FOREIGN PATENT DOCUMENTS

| | | | |
|---|---|---|---|
| DE | 4414462 | A1 | 11/1995 |
| EP | 0545329 | A2 | 6/1993 |
| GB | 2310997 | A | 9/1997 |

OTHER PUBLICATIONS

English Language Abstract for DE 44 14 462.
English Language Abstract for EP 0 545 329.

* cited by examiner 12
16
18
120
122
124
126
128
130
132
133
134
135
138
139
140
142
146
148
151
154
156

DEVICE FOR ADJUSTABLE MOUNTING OF THE RUNNER OF PULL-OUT GUIDES ON DRAWERS

This application is a 371 application of PCT/EP2007/001514 filed Feb. 22, 2007, which claims priority to the German application DE 20 2006 003 035.2 filed Feb. 25, 2006.

The invention relates to a device for adjustable mounting of the rear end of runners of pull-out guides on the inner end region, facing away from the front panel, of drawers or other furniture components withdrawably mounted in the carcass of a piece of furniture, with a mounting element which is disposed so as to be adjustable in height on the rear end of the runner and which can be brought into sliding engagement with a receiving arrangement provided on the rear of the drawer by relative displacement of the drawer on the runner in the longitudinal direction of the runner.

Nowadays the rear end, located inside the carcass, of the runner of drawer pull-out guides to be disposed in a flush-mounted arrangement below the base of drawers is usually mounted in such a way that a retaining lug, which is provided on a bent-up flank projecting from the upper face of the runner and extends parallel to the upper face of the runner, is inserted into an opening provided in the rear wall of the drawer and in the rear end region of the drawer side wall frame. This type of mounting enables the rear end of the drawer to be fitted and removed without tools on the runner of pull-out guides pre-installed in the associated furniture carcass by pushing it onto or pulling it back from the retaining lug. After push-on fitting, the rear end region of the drawer is connected to the runners so as to be secured against lifting off. For cases in which a subsequent change in the inclination of the front panel of a drawer is required without a change to its height relative to the carcass, a device for adjusting the height of the drawer in the rear end region has been developed in which the retaining lug, which was hitherto rigidly connected to the runner, is constructed so as to be adjustable in the vertical direction.

The object of the invention is to create a device for mounting the rear end, which is located inside the carcass, of the runner so as to be adjustable in height relative to the drawer, wherein the device not only enables a simple and quick height adjustment without the use of a tool but is basically also suitable to enable additional lateral displacement of the drawer on the runner.

Starting from a device of the type mentioned in the introduction, this object is achieved according to the invention in that the mounting element is disposed on a lever arm which is mounted on the runner so as to be pivotable in a vertical plane about an axis extending horizontally at right angles to the longitudinal direction of the runner, and a height adjusting mechanism is provided which acts on the one hand on the lever arm and on the other hand on the runner.

In a preferred embodiment of the invention the lever arm is mounted in the region of its front end on the front panel side so as to be spaced from the rear end of the runner remote from the front panel and its end remote from the front panel is provided with the mounting element.

In this case the receiving arrangement for the height-adjustable mounting element is advantageously provided in a receiving component which can be separately attached to the rear face of the drawer. In this way it is possible to construct the mounting element as a projection which projects from the lever arm and can be inserted into a receiving opening in the receiving component and can be withdrawn from the receiving opening. In this case the projection is constructed as a substantially flat plate which projects laterally from the lever arm and which can be pushed into the associated slot-like receiving opening in the receiving component and can be withdrawn from the opening.

In this case the embodiment is advantageously designed so that the flat plate projects laterally from the lever arm with its upper and lower faces extending substantially in the longitudinal direction of the lever arm, and so that the slot-like receiving opening extends at right angles and parallel to the underside of the base of the drawer, its clear height being substantially equal to the thickness of the plate projecting from the lever arm.

The lateral displacement of the drawer on the runner is possible when the length of the slot-like opening measured at right angles to the longitudinal direction of the runner is greater than the width of the plate projecting from the lever arm.

In order to fix the drawer in a specific lateral position it is advantageous if corrugations or latching grooves which extend in the longitudinal direction of the runner are provided in one of the flat faces of the plate projecting from the lever arm and the associated boundary face of the slot-like receiving opening.

In a first embodiment of the invention the height adjusting mechanism has an eccentric component which is disposed inside a slot-like hole in the lever arm and is rotatably mounted on the runner. The slot-like hole in the lever arm then extends substantially in the longitudinal direction of the lever arm.

The eccentric component preferably has a peripheral surface which is axially symmetrical with respect to its central axis, whereby the diameter of the eccentric component measured between diametrically opposing regions of the peripheral surfaces is substantially equal to the width of the hole measured between the opposing longitudinal boundary surfaces of the slot-like hole in the lever arm. In an advantageous embodiment the eccentric component has a cylindrical peripheral surface in its region located inside the hole in the lever arm. Alternatively, the peripheral surface of the eccentric component can also be formed in its region located inside the hole in the lever arm by a plurality of flat areas which succeed one another in the peripheral direction.

In order to make the lifting path available for the height adjustment, the eccentric component is then advantageously mounted on the runner so as to be rotatable about an axis extending eccentrically with respect to its central axis.

A rotary actuating handle, which preferably has an actuating lever projecting radially from the eccentric component at right angles to the central axis of the eccentric component, can then be provided on the flat face of the eccentric component facing away from the runner.

An enlarged gripper plate projecting from the side of the actuating lever facing away from the runner can then advantageously be provided on the free end of the actuating lever.

In an alternative embodiment the design is such that the lever arm is provided, on its surface facing away from the runner, with an elongate adjusting slide mounted so as to be displaceable in the longitudinal direction of the runner and having a guide surface arrangement which is inclined obliquely relative to the direction of displacement and which co-operates with a control projection which is mounted on the runner so that it is immovable in the longitudinal direction of the runner.

The guide surface arrangement is then advantageously formed by the opposing parallel walls of a guide slot which is provided in the adjusting slide and extends obliquely with respect to the longitudinal direction of the runner, and a lug portion of the control projection, which is dimensioned in accordance with the width of the slot in the region of engagement in the guide slot, engages in the guide slot.

The end of the lug portion of the control projection which protrudes out of the guide slot at its end facing the runner advantageously engages fittingly in an arcuate slot in the lever arm which extends concentrically with respect to the pivot axis of the lever arm and which allows the lever arm to pivot, whilst the free end of the lug portion on the runner side is fixed rigidly in or on the runner.

In this case the elongate adjusting slide is preferably guided in the direction of displacement so that its position can be varied by two strip-shaped guide elements which engage fittingly over its opposing parallel upper and lower flat faces and project from the facing flat face of the lever.

In order to prevent unwanted adjustment of a selected raised position of the rear face of the drawer, latching projections and latching recesses which extend transversely with respect to the adjustment direction of the slide can be provided in the flat face, facing the slide, of the lower strip-shaped guide element and the lower flat face of the adjusting slide facing the other flat face.

The adjusting slide is provided on its face facing away from the lever arm with a projecting handle in order to simplify its actuation.

The invention is explained in greater detail in the following description of two embodiments in conjunction with the drawings, in which.

Figure 1:
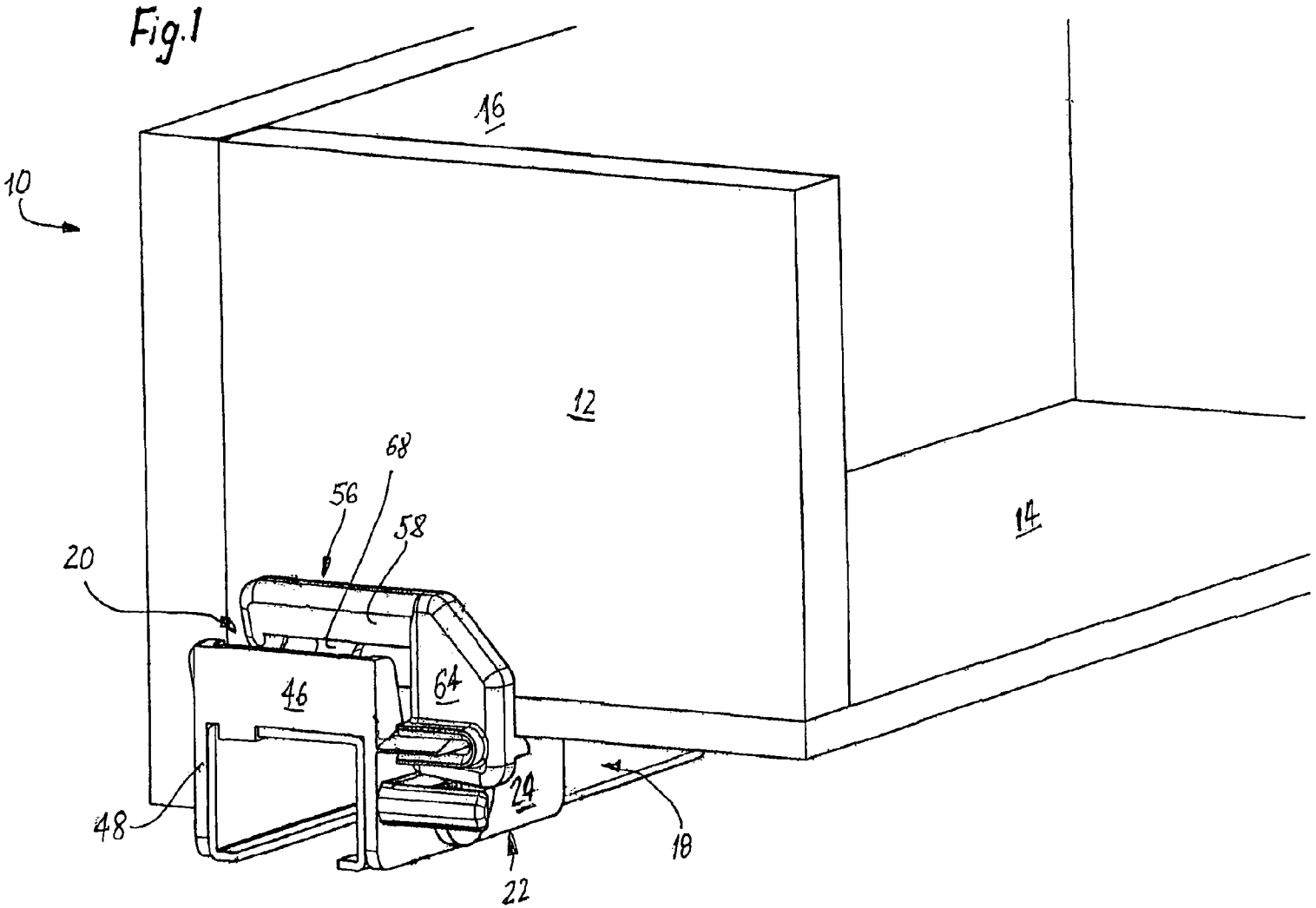
FIG. 1 is an isometric view of a corner region, on the rear wall side, of a drawer with a first embodiment of mounting device constructed in accordance with the invention for the rear end of the associated runner of a pull-out guide in the mounting position in which the base of the drawer rests on the upper web surface of the runner.

FIGS. 1, 2, 3 and 5 shows schematically a rear corner region of a drawer 10, showing the rear wall 12 which in the special case is made from wood material in board form, the base 14 and a side wall 16 partially). As can be seen best in FIG. 3, a strip-shaped lower edge region of the side wall 16 projects over the underside of the base 14 fitted into the side wall 16. In this edge region of the side wall 16 lying below the base 14 there is disposed the runner 18 of a pull-out guide—not shown in greater detail—of which the rear end can be mounted on the drawer 10 so as to be adjustable vertically and laterally by an embodiment, designated as a whole by 20, of a mounting device according to the invention.

Figure 4:
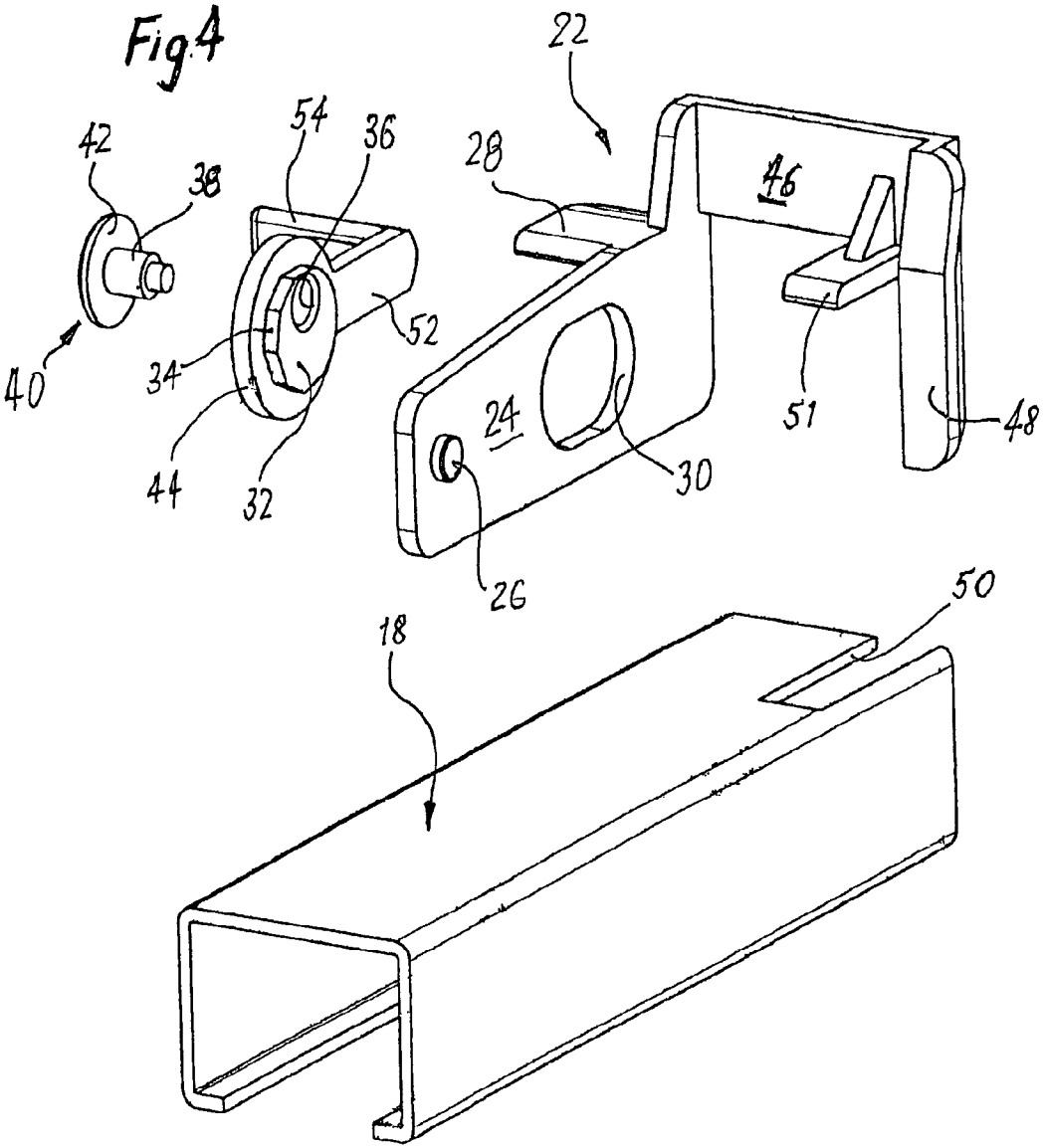
FIG. 4 is an isometric view of the rear end region of a runner in a position which is rotated relative to the representations in FIGS. 1 and 2 and of the mounting element which can be pivotably attached to the runner and of the functional parts of the height adjusting mechanism of the mounted device shown separately.

The mounting device 20 has a mounting element 22, shown separately above the runner 18 in FIG. 4, with a flat elongate lever arm 24 which. in lateral abutment on the vertical flank surface of the runner 18 facing away from the observer in FIG. 4, is mounted so as to be pivotable about a horizontal axis A at right angles to the longitudinal direction of the runner on the rear end of the runner by means of a bearing journal 24 which engages in a bearing bore (not shown) in the runner 18 and projecting from the lever arm 24. The actual mounting element 22 is provided in the end, inside the carcass, lying opposite the bearing journal in the region of the lever arm 24 and is constructed as a substantially flat plate 28 projecting from the side facing away from the runner. A slot-like hole 30 which is oriented substantially in the longitudinal direction of the lever arm is provided in the region between the bearing journal 26 and the plate 28. The hole 30 serves to receive an eccentric component 32 with a peripheral surface 34 which is axially symmetrical relative to its central axis and which may be either of cylindrical construction or—in the manner illustrated in FIG. 4—may be constructed with a plurality of successive flattened areas in the peripheral direction. A bearing bore 36 is offset eccentrically with respect to the central axis of the eccentric component and through this bearing bore a cylindrical lug portion 38 of a bearing component 40 can be passed which is provided on one end with a disc-shaped head plate 42 of enlarged diameter.

A short lug projection of reduced diameter which projects from the free end face of the lug portion 38 can be fixed in a suitable manner—for example by riveting or soldering—in a further bore (not shown) in the flank surface of the runner 18 facing away from the observer. Thus the bearing journal 26 engages in the associated bearing bore (not shown) in the position of the pivotably mounted lever arm 24 in which it rests properly on the flank surface of the runner facing away from the observer. The eccentric component 32 is held in the proper engaged position in the slot-like hole 30 by the head plate 42 bearing on the flat outer face of a disc-shaped plate 44 of enlarged diameter relative to the eccentric component 32. At the same time the lever arm 24 is also held in abutment on the flank surface of the runner 18, so that the bearing journal 26 is reliably prevented from coming out of the associated bearing bore.

A strip-shaped cross-member 46 is also attached to the flat lying opposite the mounting element 22 constructed as a plate 28 and has on its free end a downwardly-directed guide arm 48 which is provided with a lead-in slope relative to the longitudinal direction of the mounting rail and which in the proper mounting position bears on the outside of the flank surface of the runner 18 facing the observer. In addition a strip-shaped projection 51 of complementary dimensions which is integrally attached to the cross-member 46 engages in a slot-shaped cutout 50 stamped in the longitudinal direction of the runner into the rear end of the web surface of the runner 18.

A rotary actuating handle which is constructed as a lever 52 and has an enlarged gripper plate 54 attached to its free end projects radially from the disc-shaped plate 44 of the eccentric component 32.

A receiving component 56 which is to be fixed on the rear wall 12 of the drawer and co-operates with the mounting element described above is shown in FIG. 3 in a position in which it is not yet fixed on the rear wall of the drawer, i.e. it is spaced in front of the rear wall 12 of the drawer. The receiving component which in the illustrated case is constructed as an injection moulded plastics part has an upper elongate horizontally extending mounting portion 58 which can be fixed on the rear face of the rear wall by means of two fixing lugs 62 to be pressed into bores 60 in the rear wall 12 of the drawer. A receiving plate 64 which extends downwards to below the level of the underside of the drawer base 14 is integrally attached to the end of the portion 58 pointing away from the side wall 16 of the drawer, and a horizontally extending slot-like receiving opening 66 which opens on the side wall side is formed in the receiving plate. During fitting of the drawer in a cabinet carcass the projection of the mounting element 22, which is constructed as a plate 28 and projects laterally from the lever arm 24 pivotably mounted in the runner 18, can be pushed into the slot-like receiving opening 66 and—during subsequent removal of the drawer from the associated pull-out guide of the cabinet carcass—can be pulled out again. A resilient tab which projects downwards from the mounting portion 58 and is offset laterally with respect to the receiving plate 64 serves in co-operation with the runner 18 to equalise tolerances.

The width of the slot-like receiving opening 66 is greater than the width of the plate 28 of the mounting element which engages in it, so that this plate is movable by a predetermined amount not only in the longitudinal direction of the runner but also at right angles thereto. Thus as a result a lateral displacement of the drawer 10 is also possible.

Figure 6:
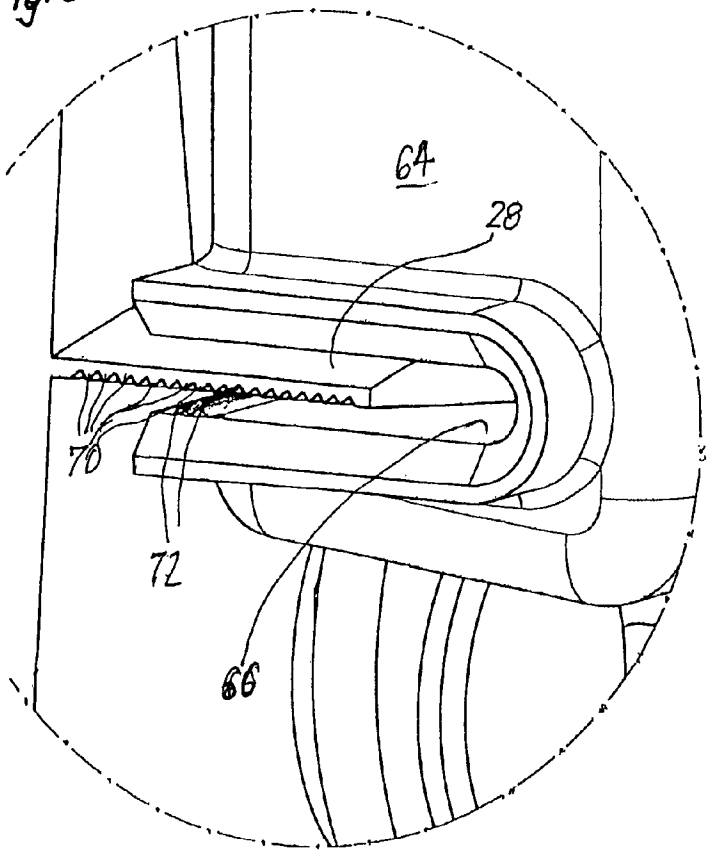
FIG. 6 is an enlarged representation of the region of the mounting device lying within the dash-dot circle in FIG. 2.
Figure 3:
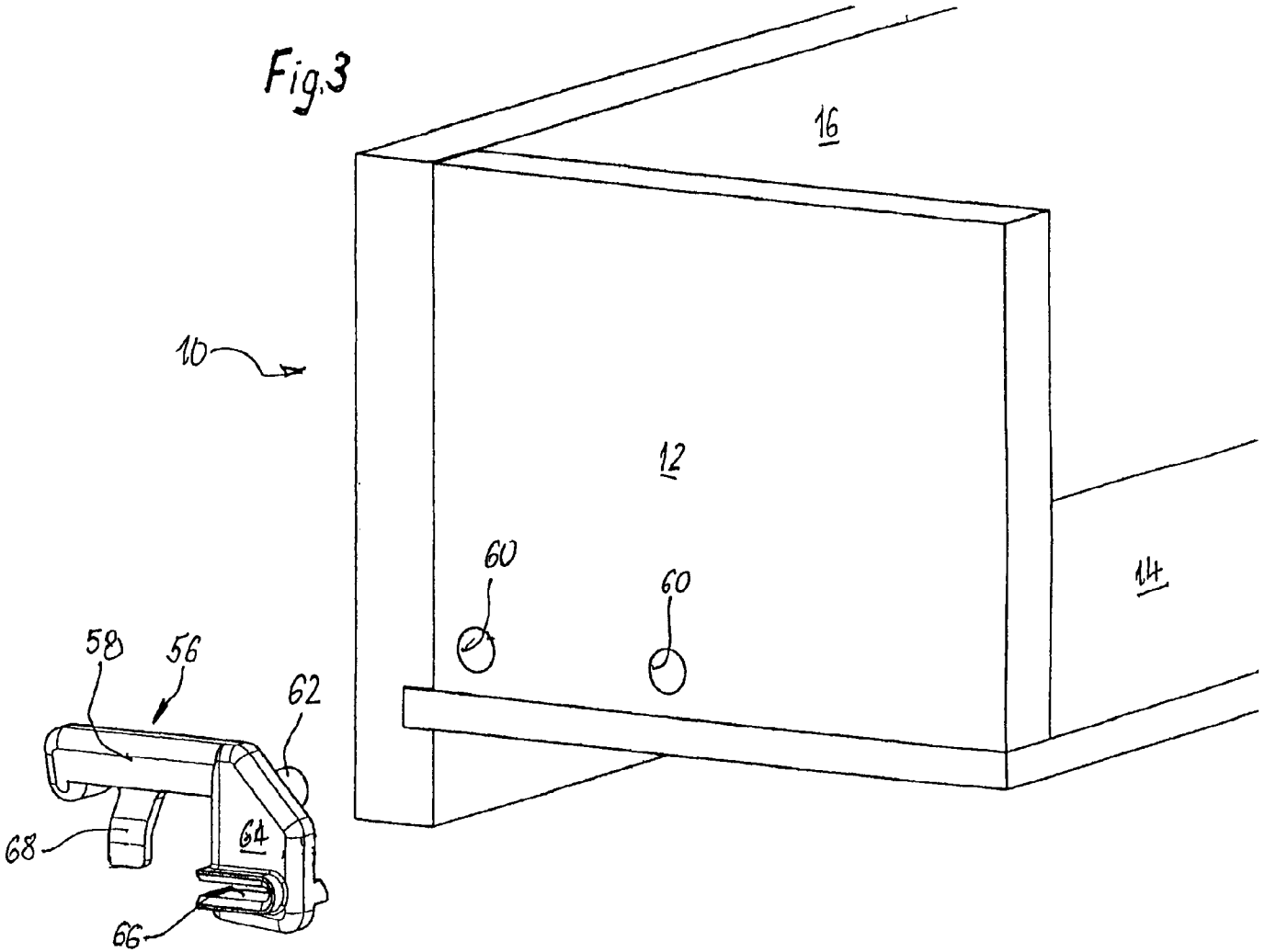
FIG. 3 is an isometric view of the rear corner region of the drawer illustrated in FIGS. 1 and 2 and of the receiving component of the mounting device to be fixed on the rear wall of the drawer, in a position illustrated with a spacing in front of the rear wall.

As can be seen in FIG. 6, the plate 28 is provided on its underside with a plurality of corrugations or grooves 70 extending in the longitudinal direction of the runner which co-operate with two associated latching teeth 72 which projects from the upper face of the lower boundary surface of the slot-like receiving opening 66 and also extend in the longitudinal direction of the runners in order to prevent unwanted lateral displacement of the drawer out of a selected lateral position in the cabinet carcass.

Figure 2:
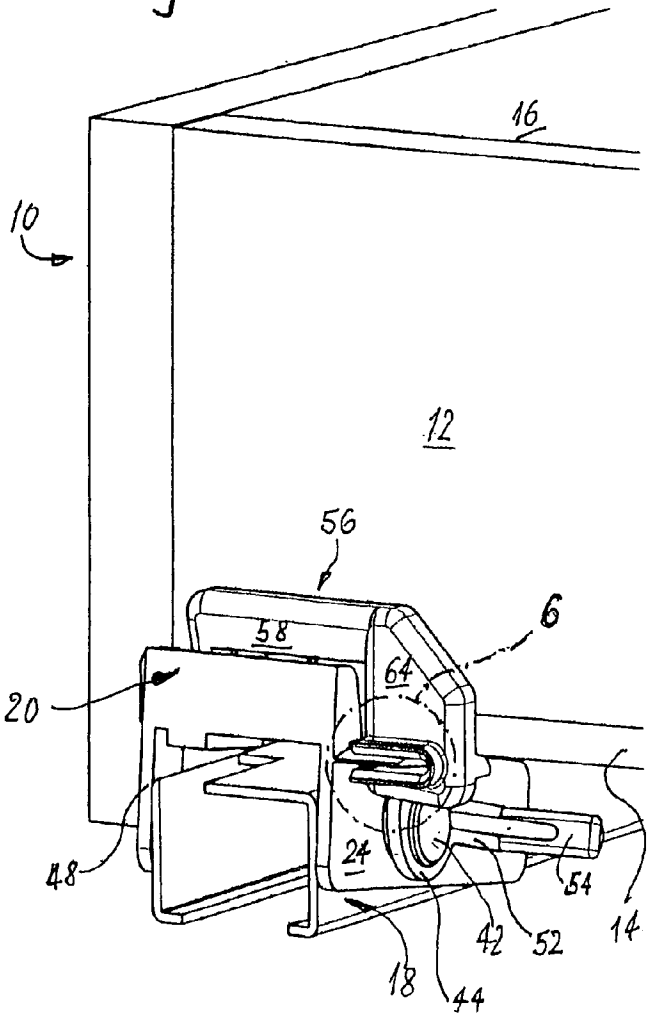
FIG. 2 is a view corresponding to FIG. 1 in a position of the rear face of the drawer which is raised in the vertical direction from the upper face of the runner relative to the representation according to FIG. 1.
Figure 5:
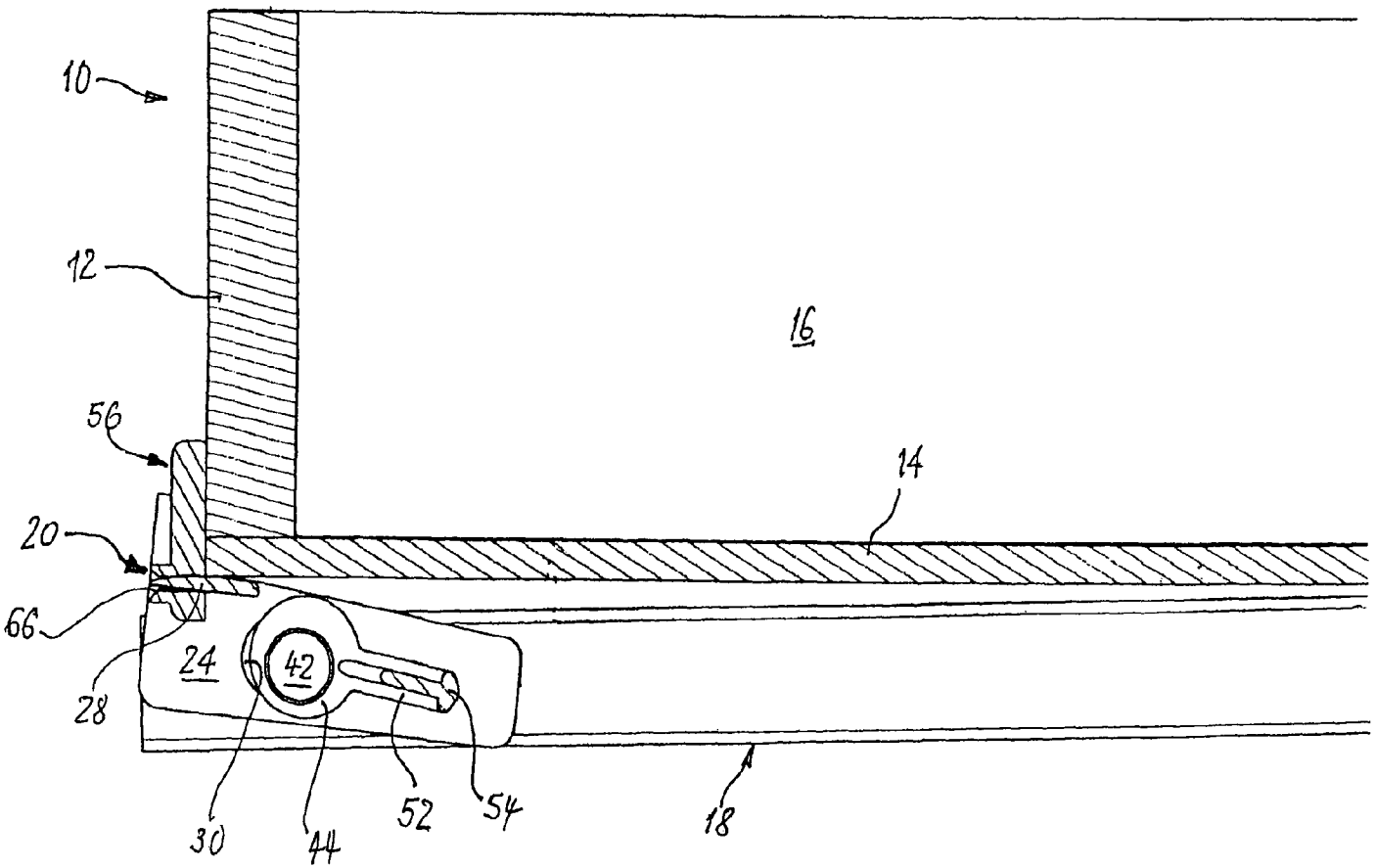
FIG. 5 is a sectional view in the direction of the arrows 5-5 in FIG. 2.
Figures 7, 8, 9:
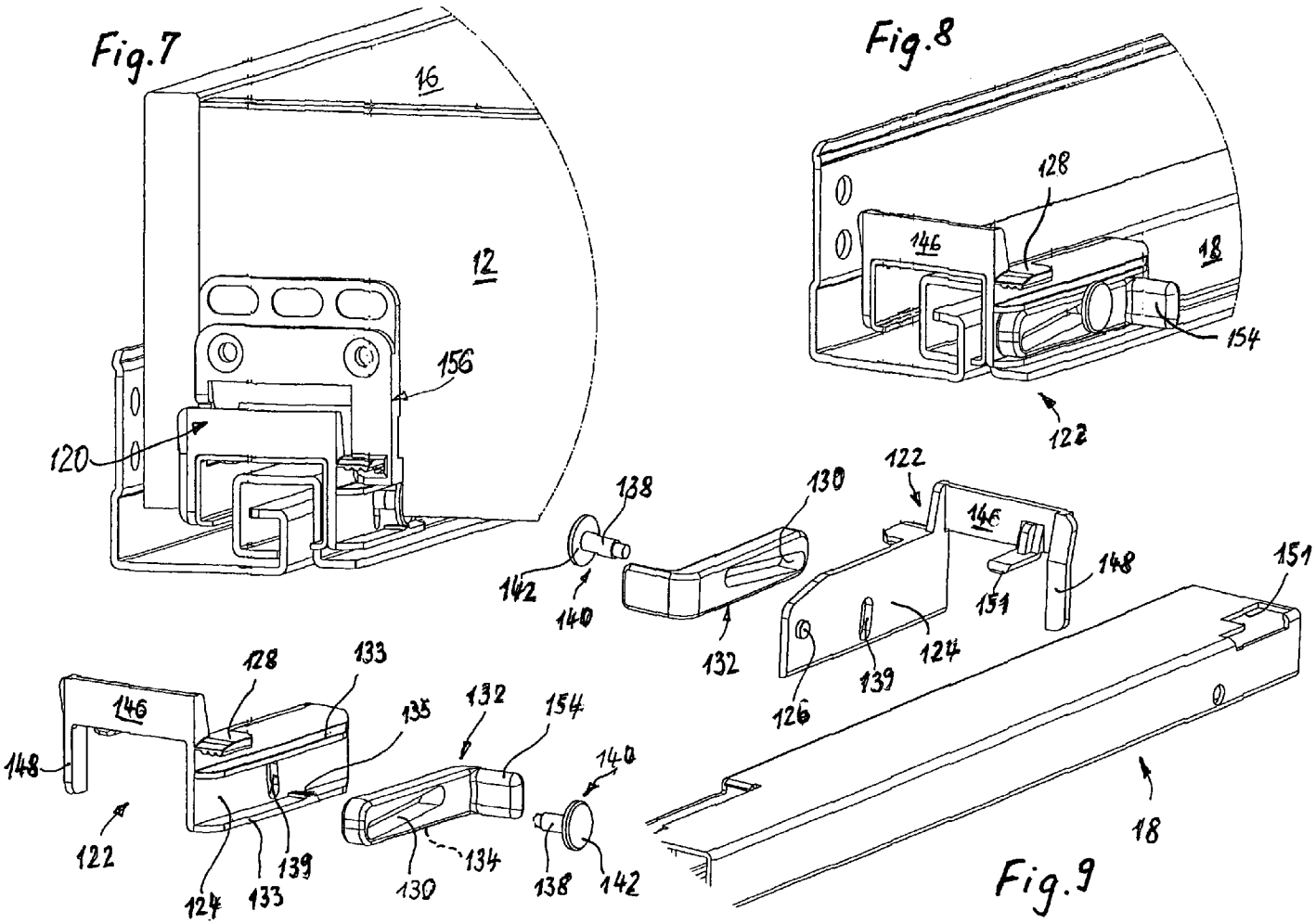
FIG. 7 is an isometric view of the region of a drawer on the rear wall side with a second embodiment of a mounting device constructed in accordance with the invention for the rear end of the associated runner of a pull-out guide.
FIG. 8 shows the rear end region of the pull-out guide shown in FIG. 7 without the drawer placed on it.
FIG. 9 is an isometric view of the rear end portion of a runner in a position, rotated relative to the representation in FIGS. 7 and 8, of the mounting element which can be pivotably attached to the runner and of the functional parts of the height adjusting mechanism of the second embodiment of the mounting device shown separately.
Figure 10:
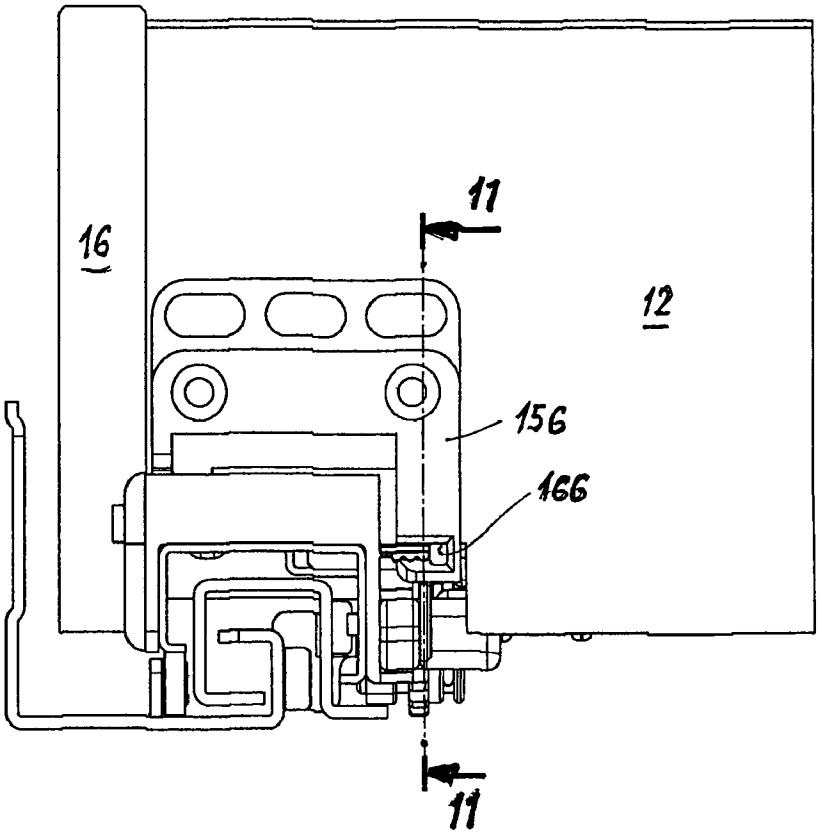
FIG. 10 is a view of the rear corner region of the drawer shown in FIG. 7, viewed in the direction of displacement of the guide rail of the pull-out guide.
Figure 11:
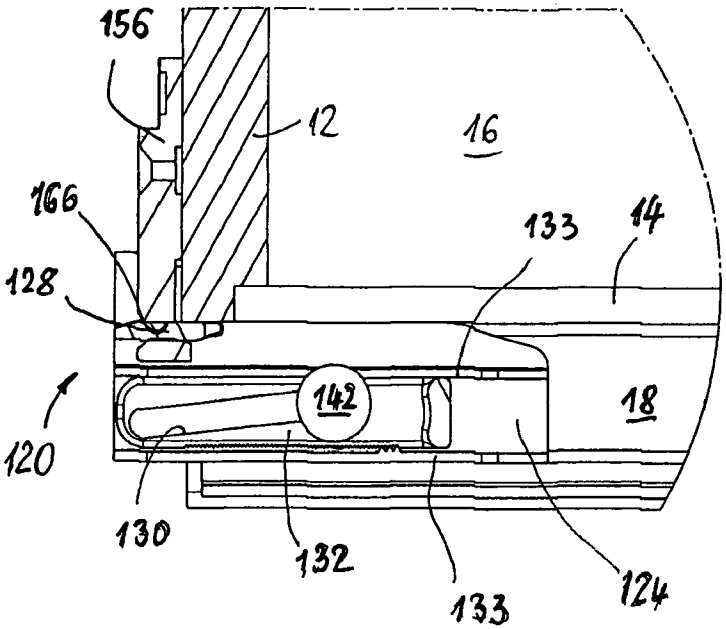
FIG. 11 is a sectional view in the direction of the arrows 11-11 in FIG. 10.

In FIGS. 1, 2 and 5 the drawer is illustrated in the position in which it is placed by means of the mounting device 20 according to the invention in the proper fixing position on the runner 18, wherein FIG. 1 shows the initial position in which the drawer base 14 rests on the upwardly directed web surface of the runner 18. It can be seen that in this case the gripper plate 54 attached to the free end of the lever 52 of the eccentric component 32 which projects radially from the disc-shaped plate 44 is pivoted into the position pointing towards the rear end of the runner 18. By turning of the lever 52 in the anti-clockwise direction the eccentric component is turned into the slot-like hole 30 and the lever arm 24 is correspondingly pivoted in the upward direction, so that by transmission of the pivoting movement of the lever arm 24 by way of the plate 28 engaging in the slot-like receiving opening 66 of the receiving component 56 the drawer is entrained in the upward direction, i.e. is pivoted upwards with the end on the rear wall side. FIGS. 2 and 5 show the maximum raised position of the drawer 10 achieved when the lever arm 52 is pivoted by approximately 180°. The gripper plate 54 attached to the end of the lever 52 then points away from the rear end of the runner 18 towards the front end thereof.

It is now apparent from the preceding description that by means of the embodiment of the mounting device 20 described above it is possible to adjust the height of the rear end of a drawer 10 by the amount of the eccentricity of the eccentric component 32 and also to displace the drawer laterally by the possibility of displacement of the plate 28 in the slot-like receiving opening 66, which is longer than the latter, of the receiving component.

In FIGS. 7 to 11 a second embodiment of a mounting device 120 according to the invention is described which corresponds in principle to the mounting device described above in connection with FIGS. 1 to 6. Therefore—in order to avoid unnecessary repetitions—only the differences between the two embodiments relating to the design and the operation of the height adjusting mechanism are described in greater detail, whilst reference may be made to the preceding description for the corresponding design since components of both embodiments which correspond functionally are identified in the drawings by the same reference numerals preceded—in the case of the second embodiment—by "1".

In the mounting device the eccentric component 32 of the first embodiment which engages in a hole 30 in the lever arm is replaced by an elongate adjusting slide 132 which is mounted so as to be longitudinally displaceable on the flat face of the outer surface of the lever arm 124 facing away from the runner. This longitudinally displaceable guiding is effected by two strip-shaped guide elements 133 which engage over the opposing parallel upper and lower flat faces of the adjusting slide 132 and project from the facing flat side of the lever. In the adjusting slide 132 a guide surface arrangement is provided in the form of a guide slot 130 which extends obliquely with respect to the longitudinal direction of the runner and through which a cylindrical shank portion 138 of a control projection 140 passes which extends through the guide slot 130 and on the runner side is additionally guided through an arcuate slot 139 in the lever arm 124. The free end of the lug portion 138 is riveted in a hole—not shown—in the runner 18. At the opposite end a head plate 142 is provided which has a larger diameter and which retains the adjusting slide 132 in the proper mounting position between the strip-shaped guide elements 133.

A gripper plate 154 which projects laterally on the front end of the adjusting slide 132 pointing towards the front panel of the drawer is provided as a handle for displacement of the adjusting slide. Low sharp-pointed latching projections project from the upper flat face of the lower guide element 133 facing the adjusting slide 132 and co-operate with complementary latching recesses 134 provided in the facing underside of the adjusting slide 132. Thus the adjusting slide 132 is now displaceable within the displacement path predetermined by the length of the guide slot 130 between the strip-shaped guide elements 133. In this case, due to the inclination of the guide slot 130 through which the lug portion 138 fixed on the runner passes, during a longitudinal displacement of the lever arm 124 the pivotable mounting element 122 as a whole is thus pivoted, so that the drawer is pivoted by transmission of the pivoting movement of the lever arm 124 by way of the plate 128 engaging in the slot-like receiving opening of the receiving component 156. In this case the maximum pivoting path is predetermined by the difference in height between the ends of the guide slot 130.

It can be seen that within the scope of the idea underlying the invention modifications and variants of the described embodiment can be provided which relate for example to the fixing of the receiving component 56 on the drawer. Instead of the fixing lugs provided here which can be pressed into holes 60 in the rear walls, a screw connection can also be provided in which the receiving component is fixed directly with fixing screws on the rear wall 12. Alternatively the fixing lugs 62 can also be constructed as fixing lugs which can be spread apart in the manner of expanding dowels by screwing in screws. Within the scope of the invention it is important that the mounting element pivotably mounted on the rear end of the mounting rail 18 is pivotable in a smooth or delicately stepped manner by turning of an eccentric component or displacement of an adjusting slide and thus a height adjustment of the drawer 10 and also by corresponding design of the sliding connection of the functional component of the mounting element 22 and the receiving component 56 a lateral displacement of the drawer transversely with respect to the runner in the longitudinal direction is possible.

The invention claimed is:

1. A device for adjustable mounting of a rear end of a runner (18) of a pull-out guide on an inner end region, facing away from a front panel, of a drawer (10) or a furniture component withdrawably mounted in a carcass of a piece of furniture, the device comprising:

a mounting element (122) disposed so as to be adjustable in height on the rear end of the runner (18) which is brought into sliding engagement with a receiving arrangement provided on the rear of the drawer (10) by relative displacement of the drawer (10) on the runner (18) in longitudinal direction of the runner, wherein the mounting element (122) is disposed on a lever arm (124) which is mounted on the runner (18) so as to be pivotable in a vertical plane about an axis (A) extending horizontally at right angles to the longitudinal direction of the runner, and a height adjusting mechanism is provided which acts on the lever arm (124) and on the runner (18), wherein the lever arm (124) has a surface facing away from the runner, with an elongate adjusting slide (132) mounted so as to be displaceable in longitudinal direction of the runner and having a guide surface arrangement which is inclined obliquely relative to the direction of displacement and which co-operates with a control projection (140) which is mounted on the runner so that it is immovable in the longitudinal direction of the runner.

2. The device as claimed in claim 1, wherein the guide surface arrangement is formed by the opposing parallel walls of a guide slot (130) which is provided in the adjusting slide (132) and extends obliquely with respect to the longitudinal of the runner, and a lug portion (138) of the control projection (140), which is dimensioned in accordance with the width of the slot in the region of engagement in the guide slot (130), engages in the guide slot.

3. The device as claimed in claim 2, wherein the end of the lug portion (138) of the control projection (140) which protrudes out of the guide slot (130) at its end facing the runner engages fittingly in an arcuate slot (139) in the lever arm (124) which extends concentrically with respect to the pivot axis of the lever arm (124).

4. The device as claimed in claim 3, wherein the elongate adjusting slide (132) is guided in the direction of displacement so that its position can be varied by two strip-shaped guide elements (133) which engage fittingly over its opposing parallel upper and lower flat faces and project from the lacing flat face of the lever.

5. The device as claimed in claim 4, wherein latching projections (135) and latching recesses (134) which extend transversely with respect to the adjustment direction of the slide are provided in the flat face, facing the slide, of the lower strip-shaped guide element (133) and the lower flat face of the adjusting slide (132) facing the other flat face.

6. The device as claimed in claim 1, wherein the adjusting slide (132) is provided on its face facing away from the lever arm (124) with a projecting handle (154).

* * * * *